United States Patent [19]

Whang

[11] 4,161,847

[45] Jul. 24, 1979

[54] APPARATUS AND METHOD FOR PERFORMING ASPHERICAL OPERATIONS ON A WORKPIECE

[75] Inventor: Uoo S. Whang, Waco, Tex.

[73] Assignee: New Asian Corporation, Waco, Tex.

[21] Appl. No.: 783,969

[22] Filed: Apr. 4, 1977

[51] Int. Cl.[2] ..... B24B 13/00; B24B 17/02

[52] U.S. Cl. ..... 51/33 W; 51/55

[58] Field of Search ..... 51/33 R, 33 W, 55, 58, 51/105 LG, 90, 114, 120, 124 L, 131 D, 284; 90/11 C, 13.7, 15 A

[56] References Cited

U.S. PATENT DOCUMENTS

| | | | |
|---|---|---|---|
| 960,188 | 5/1910 | Nichols | 51/90 |
| 1,635,469 | 7/1927 | Ericsson | 51/90 |
| 2,016,134 | 10/1935 | Culver | 51/120 |
| 3,111,789 | 11/1963 | Harmon | 51/90 X |
| 3,732,647 | 5/1973 | Stith | 51/90 |
| 3,900,972 | 8/1975 | Rupp | 51/58 X |

*Primary Examiner*—Gary L. Smith

*Attorney, Agent, or Firm*—Hubbard, Thurman, Turner, Tucker & Glaser

[57] ABSTRACT

An apparatus and method for performing conic sectional operations on a workpiece is disclosed. The apparatus includes a conic surface generator which traces the surface of a cone and a cutting plane generator which traces a plane so that the plane intersects the surface of the cone. The conic surface and the cutting plane generator are connected by a conic section follower which traces the intersection of the cone and the plane. The apparatus also includes a working interface for working on a workpiece and connecting means for connecting the working interface to the conic section follower so that the working surface traces a conic section equivalent to that generated by the intersection of the cone and plane.

A center of curvature guide accurately positions the working interface to provide the capability of substantially single point contact cutting and polishing.

12 Claims, 14 Drawing Figures

FIG. 12
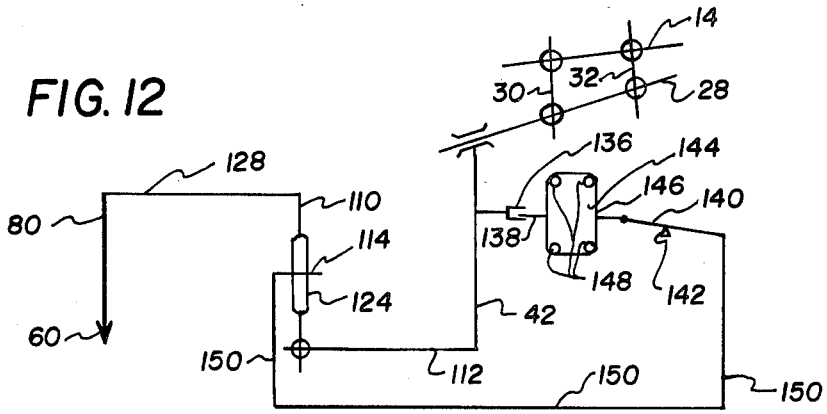
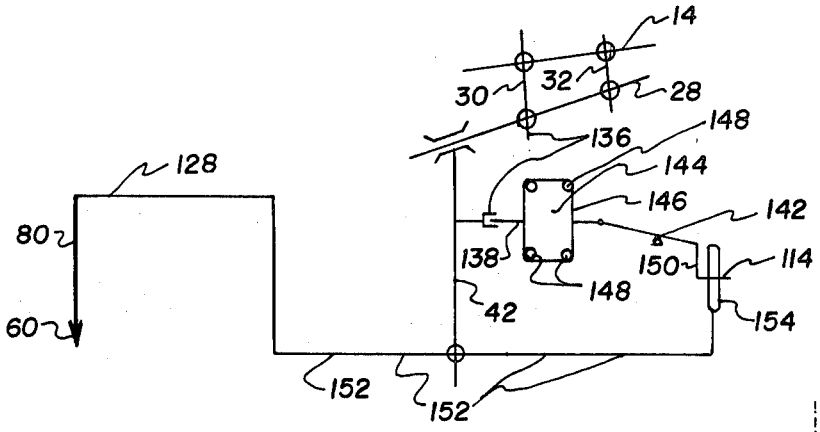
FIG. 13
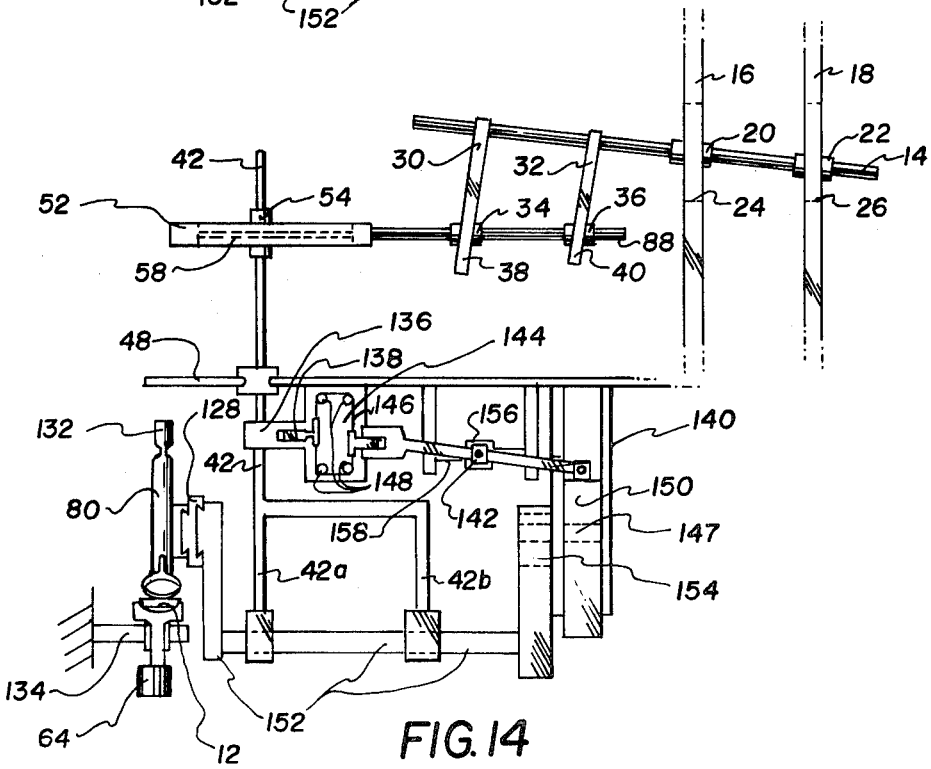
FIG. 14

APPARATUS AND METHOD FOR PERFORMING ASPHERICAL OPERATIONS ON A WORKPIECE

This invention relates generally to an apparatus and method for creating or finishing aspheric surfaces and in one of its aspects to such apparatus and methods for producing conic sectional aspheric lens or similar articles. Reference is made to Disclosure Document Number 039957 entitled "Aspheric Surfacing Unit for Lenses and Mirrors, and Linkage Unit for Guiding the Center of Aspheric Curvatures, and Lapping Unit for Surfacing Aspherics" filed Apr. 4, 1975, by Uoo Sung Whang.

Aspheric surfaces for optical lenses, mirrors and similar articles have a wide variety of uses in optics, solar energy applications, telescopy, ophthalmic lenses, and other fields. Aspheric surfaces may be represented by conic cross sections which are created by a plane intersecting a cone to form, for example, circles, ellipses, parabolas and hyperbolas, and they are especially useful because of their properties of focusing or concentrating incident radiation. The desirable properties of aspheric surfaces for lenses, mirrors, etc. in the form of these conic sections have long been recognized, but creating conic sectional aspheric surfaces has been time-consuming and expensive in the past, reducing the usage of lenses and mirrors of these beneficial shapes.

Early attempts at automating lens surfacing were directed almost exclusively toward the production of spherical lenses as shown in U.S. Pat. No. 1,659,277 issued to A. E. Maynard and U.S. Pat. No. 2,633,675 issued to C. A. Ellis. The machine shown in the Ellis patent uses a rotating ring or cup-type abrading tool and oscillates the workpiece about an axis which passes through the center of the spherical surface being created while sweeping the tool in an arc transverse to that of the workpiece. Such a method can be used for creating lenses with single or compound surface curvatures, but the meridians of the articles created are still circular.

The systems described in these patents can only be used to manufacture a limited number of surface shapes, primarily surfaces which are circular along their meridians.

In recent years, attempts have been made to automate the productions of aspheric lenses. One such method is shown in U.S. Pat. No. 3,778,937 issued to Charles W. Neefe which starts with a spherical convex surface and abrades that surface with an inner surface of a concave cone while moving the cone in an oscillating manner over the spherical surface.

The device shown in the Neefe patent is limited to convex surfaces and cannot be generalized to create other shapes. Also, the shape of the surfaces created cannot be predetermined with great accuracy since the amount of abrading is empirical.

It is, therefore, an object of this invention to provide improved apparatus and methods for automating the productions of conic sectional aspheric surfaces.

Another object of this invention is to provide such apparatus and methods for creating both convex and concave surfaces.

Another object of this invention is to provide apparatus which can create the desired aspheric surfaces in a single stage process without first creating spherical surfaces and then reworking the spherical surfaces.

Also, it is an object of this invention to provide in a single apparatus a means for generating surfaces representing an entire family of geometric curves.

It is yet another object of the present invention to provide an apparatus which can be easily modified for creating a surface of given characteristics, and in which the shape of the curve to be generated can be predetermined fairly accurately.

When cutting continuous complex curves with a workpiece or cutting tool, a difficult problem which the prior art has not solved is to provide apparatus which automatically positions the cutting tool substantially perpendicular to the workpiece at any point in the cutting operation. This is desirable in order to maintain the accuracy of the cutting operation by insuring that the cutting tool maintains a substantial point contact with the workpiece at all times instead of a surface contact.

It is thus a further object of this invention to provide apparatus and methods which have the capability of providing substantially single point contact cutting and polishing of spherical and aspherical surfaces.

In accordance with the preferred embodiment of this invention illustrated herein, these and other objects of this invention are accomplished by providing apparatus which includes a conic surface generator for tracing the surface of a cone, a cutting plane generator which describes a plane intersecting the conic portion traced, and a conic section follower which traces the intersection of the cone and the plane. A connecting means connects the conic section follower to a working interface in such a way that the working interface performs operations on a workpiece in accordance with the conic section generated. The connecting means may also include a center of curvature guide which may be provided to cause the cutting tool to maintain a substantially single point contact with the workpiece by means of swiveling the working interface tool holder about a point on a line normal to the curve of the surface being worked on.

These and other objects, advantages and features of this invention will be apparent from the following description taken with reference to the accompanying drawings, wherein is shown the preferred embodiments of the invention:

FIG. 12 is a simplified diagram of an apparatus utilizing a center of curvature guide according to this invention;

FIG. 13 is a simplified diagram of another embodiment of an apparatus utilizing a center of curvature guide according to this invention; and FIG. 14 is an elevational view of an apparatus similar to the diagram of FIG. 13.

Figure 1:
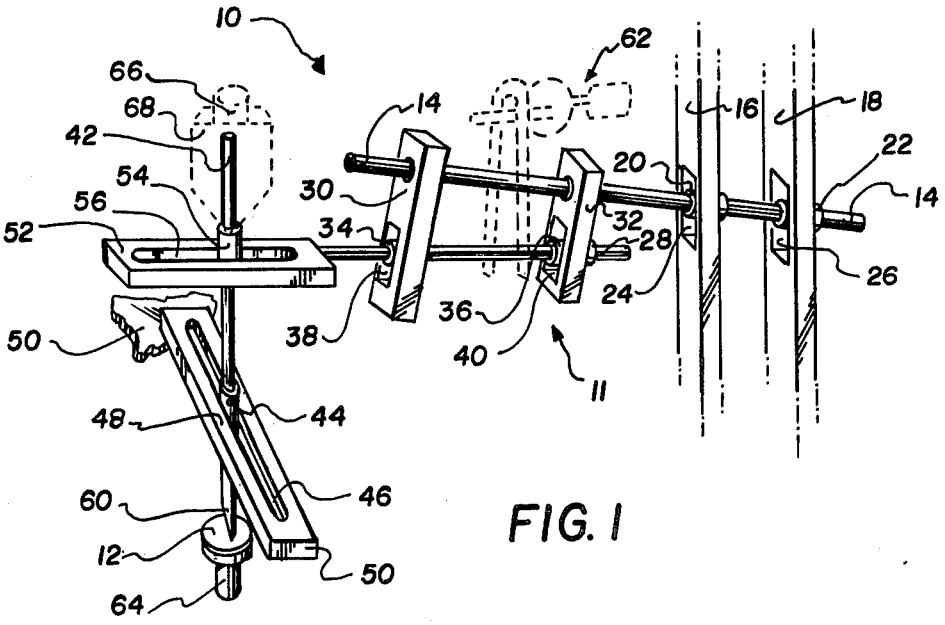
FIG. 1 is a perspective view of an apparatus for performing conic sectional operations on a workpiece utilizing this invention.

Referring to the drawings, an apparatus 10 for performing conic sectional aspheric operations on a workpiece 12 is illustrated in FIG. 1. Apparatus 10 includes a conic surface generator 11 which in the preferred embodiment of this invention illustrated includes a shaft 28 which is slanted with respect to the axis of a cone to be described or traced, the two words being used interchangeably. Slanted shaft 28 can describe a cone by revolving around the axis A of the cone. In this embodiment, an axial shaft 14 is rotatably mounted with its longitudinal center along the cone axis A. Axial shaft 14 is secured to two stationary support bars 16 and 18 through bushings 20 and 22, and bushings 20 and 22 are mounted in slots 24 and 26 respectively formed in support bars 16 and 18. Each of bushings 20 and 22 pivots within its slot 24 and 26 respectively as well as moves vertically within its slot so that the angle of axial shaft 14 with respect to the stationary supports 16 and 18 can be adjusted. Once an angle has been chosen, it can be fixed by fixing the positions of bushings 20 and 22 by screw adjustments or other suitable means (not shown). By journaling or other suitable means, axial shaft 14 is free to rotate about its central axis but not to slide in a longitudinal direction.

Radially extending support bars 30 and 32 are respectively mounted on axial shaft 14 and respectively includes slots 38 and 40 through them. Slant shaft 28 is secured to the radial supports 30 and 32 by bushings 34 and 36 respectively. Radial supports 30 and 32 are affixed to axial shaft 14 so that they neither slide nor rotate with respect to the axial shaft and bushings 34 and 36 pivot within slots 38 and 40 respectively and slide within the slots in a direction longitudinal to the radial supports. Slanted shaft 28 will always be held along the line either parallel to or intersecting the line along the center of axial shaft 14 when generating conic sections, although it can be skewed for generating other shapes. Once an angle between slant shaft 28 and axial shaft 14 has been selected, bushings 34 and 36 can be tightened into position so that the angle remains constant. Through journaling or other suitable means, slant shaft 28 can rotate within bushings 38 and 36 but not slide longitudinally. It can be seen that the path of slant 28 being rotated about axial shaft 14 describes a right circular cone also called a cone of revolution. Slant shaft 28 in conjunction with axial shaft 14 and their related supports and bushings thus form the conic surface generator which is capable of generating cones of differing vertex angles with the axis of the cone at differing angles to the horizontal.

Apparatus 10 also includes a cutting plane generator which, in the preferred embodiment of this invention illustrated in FIG. 1, basically comprises a cutting plane bar which can only move so that its longitudinal center stays within a single plane. In this embodiment the cutting plane bar is a vertical bar 42 which is mounted in a plane guide 48 so that it can only move in a vertical plane determined by a plane guide 48.

Plane guide 48 is a flat, elongated bar having an elongated linear slot 46, and vertical bar 42 is held in a vertical position by a vertical restraint 44 which slides freely in slot 46 of plane guide 48. Plane guide 48 is held in a fixed position by rigid support members 50 shown cut-away so that vertical restraint 44 slides freely within slot 46 as shown more clearly in FIG. 2. Vertical bar 42 is not journaled or otherwise restrained in vertical restraint 44 so that the vertical bar moves freely in a longitudinal direction through the vertical restraint. Thus vertical bar 42 works in cooperation with vertical restraint 44 and plane guide 48 to form the cutting plane generator. By sliding vertical bar 42 back and forth in the direction of linear slot 46, the locus of the longitudinal center line of the vertical bar is that of a plane which intersects any cone generated by the conic surface generator.

Apparatus 10 also includes a conic section follower which generally comprises any means for following the intersection of the cutting plane and the cone as the cone is generated. In the preferred embodiment of this invention illustrated in FIG. 1, the conic section follower includes a conic section guide 52 which is illustrated as an elongated flat bar with a longitudinal slot 56 through it joined in a fixed relationship to slanted shaft 28. Vertical bar 42 is joined to conic section guide 52 by means of a coupler 54 which pivots freely within a slot 56 of conic section guide 52. Coupler 54 is free to slide in a direction longitudinal to the linear slot 56 along a track 58 shown in hidden lines in FIG. 2. Vertical bar 42 is coupled to coupler 54 so that it is neither free to rotate nor to slide in a longitudinal direction in respect to coupler 54. Coupler 54 and conic section guide 52 thus cooperate to form a conic section follower which follows the intersection of the cutting plane and the cone as the cone is generated by slant shaft 28 revolving about axial shaft 14.

Connected to one end of vertical bar 42 is a working interface 60 which interfaces between the rest of the apparatus and the workpiece 12. Working interface 60 can be a point or blade type cutting device, or in other embodiments of this invention, can be various rotating type abraded tools such as a diamond burr or diamond wheel. Any abrading tool can be turned by any turning means such as turning the entire vertical bar 42 by means of a tool motor 66 held in a fixed relationship to coupler 54 by rigid supports 68. In this embodiment vertical bar 42 is both one element of the cutting plane generator and is the means for connecting the working interface to the conic section follower whereby the path of the working interface describes the conic section generated by the intersection of the cone and the plane.

Figure 2:
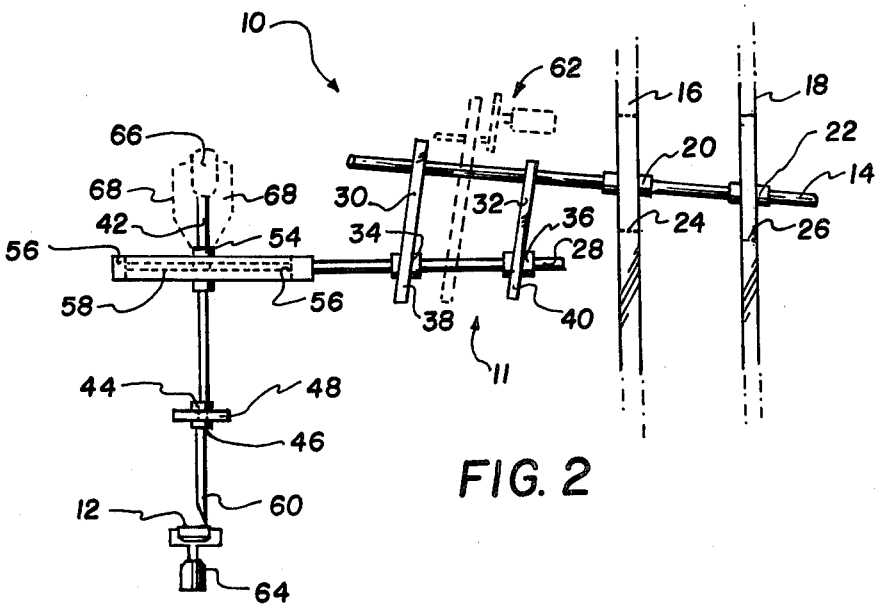
FIG. 2 is an elevational view of the apparatus of FIG. 1.

As shown in FIGS. 1 and 2, slanted shaft 28 is vertically below axial shaft 14 so as to cut a concave surface on workpiece 12. It is not necessary to revolve slant shaft 28 to complete revolutions about axial shaft 14 for any given workpiece. Slanted shaft 28 can simply be revolved back and forth in parts of a revolution as is needed to cover the particular workpiece. This oscillatory motion can be adequately accomplished by hand or any of various means which are well known in the art such as an electric motor 62.

Many variations on this device can be accomplished without departing from the scope of this invention, for example, coupler 54 can be journaled so that vertical bar 42 can rotate within the coupler but not slide longitudinally. Also, vertical restraint 44 can be keyed to a longitudinal slot on vertical bar 42 so that vertical bar 42 can move longitudinally with respect to vertical restraint 44 but not rotate.

Radial supports 30 and 32 could be made to rotate with respect to axial shaft 14, in which case axial shaft 14 could be fixed in relationship to bushings 20 and 22.

Figure 3:
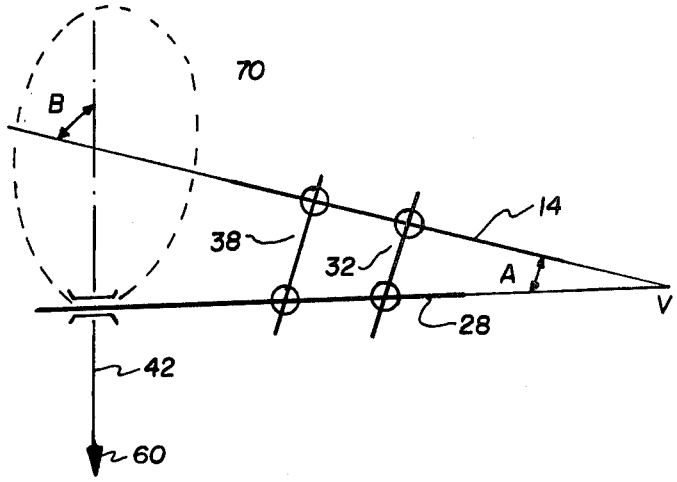
FIG. 3 is a simplified diagram of the apparatus as shown in FIG. 2 for performing operations on a concave workpiece.

A simplified version of one embodiment of the present invention is illustrated by FIG. 3 wherein corresponding elements are given the same numbers as in FIGS. 1 and 2. If lines are extended through the longitudinal axes of axial shaft 14 and slant shaft 28, they converge in vertex V creating an angle A which is half of the cone angle. An acute angle B is created between the cutting plane and axial shaft 14. If angle B is greater than angle A, then the conic section follower and hence working interface 60 traces an ellipse. If, on the other hand, angle B is less than angle A, then the working interface traces a hyperbola. Finally, if angle B equals angle A, then the curve formed is a parabola. If the angle B equals PI/2, a right angle, the curve formed is a circle so that a device made in accordance with this invention can also be used for generating the traditional spherical shapes.

Figure 4:
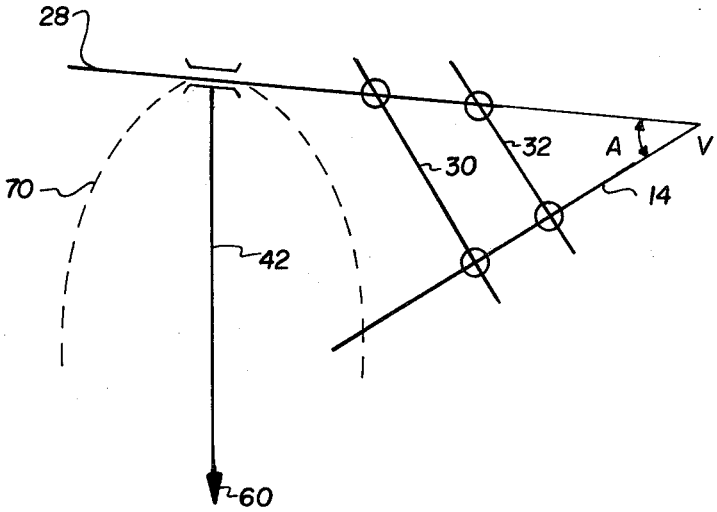
FIG. 4 is a simplified diagram of the apparatus as used to perform operations on a convex workpiece.

A simplified representation of an apparatus employing the present invention is shown in FIG. 4 with slanted shaft 28 above axial shaft 14. By revolving slanted shaft 28 back and forth above axial shaft 14, working interface 60 can perform operations on a convex workpiece.

The conic generator, the cutting plane generator and the conic section follower can each or all be in whole or part a system which includes a computer which creates the needed curves mathematically rather than mechanically. For example, a computer can solve the simultaneous equations for a cone and a plane and then step a digitally controlled cutting tool along the curve so generated.

In order to work on the three dimensional surfaces desired in the workpiece, the workpiece itself can be moved. For instance, to create a surface of revolution the workpiece can be rotated by a means such as a workpiece motor 64 while the working interface makes repetitive sweeps across it. Since the working interface only moves within the plane generated by the cutting plane generator, moving the workpiece back and forth perpendicular to that plane will create a cylindrical surface such as a cylindrical parabola, cylindrical ellipse, or cylindrical hyperbola. The workpiece can also be oscillated in a circular motion at right angles to the cutting plane.

CENTER OF CURVATURE GUIDE

Figure 5:
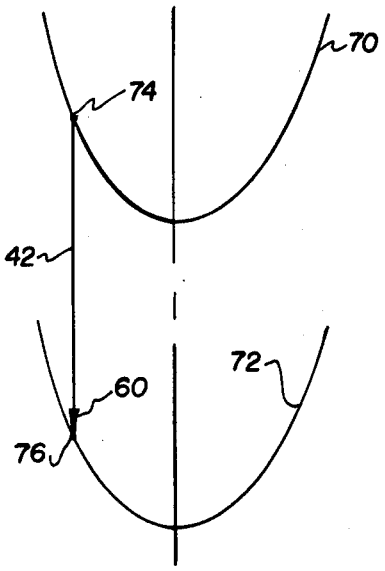
FIG. 5 is a diagram showing the relationship of the generated curve to the working surface for FIGS. 1–4.
Figure 6:
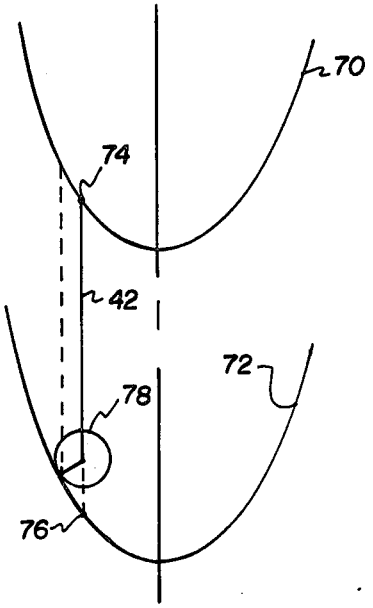
FIG. 6 is a diagram showing the relationship of the generated curve to the working surface for an apparatus similar to that shown in FIGS. 1–4 using a ring shaped tool.

The working interface 60 is preferably a point or edge type device when used for cutting in the embodiments shown in FIGS. 1–4. This becomes evident from looking at FIGS. 5 and 6 which show the locus of a point on the conic section follower which will be referred to as a generated curve 70 and a working surface 72 of workpiece 12. A point working interface will contact the working surface 72 in a single point 76 as shown in FIG. 5. The locus of the point 76 follows the locus of the point 74 in a one-to-one correspondence thus allowing accurate predetermination of the shape of the working surface by properly selecting generated curve 70.

If a blunt working interface such as a ring shaped tool 78 is used, however, contact with the working surface 72 by ring shaped tool 78 is not made at the point 76 corresponding to the point on generating curve 70 except when point 74 is at the nadir of curve 70. Since the actual point of contact on ring shaped tool 78 varies according to where the tool happens to be on the working surface, the curve actually worked by the tool does not correspond to generated curve 70.

Figure 7:
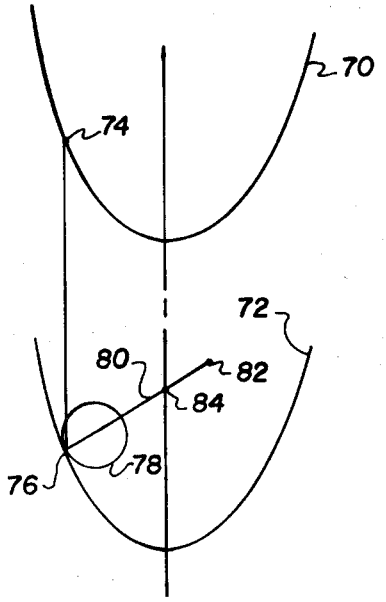
FIG. 7 is a diagram similar to FIG. 6 with a tool holder positioned normal to the working surface.

Theoretically, the problem just described can be overcome by maintaining a tool holder 80 normal to working surface 72 so that a straight line going through the center of ring shaped tool 78 and the point 76 is normal to curve 72 at point 76. This will provide a single point of contact between the ring shaped tool and working surface 72 so long as the radius of ring shaped tool 78 is less than the radius of curvature of surface 72 at point 76. As shown in FIG. 7, the center of curvature 82 of working surface 72 at the point 76 is sufficiently far away to make the radius of curvature greater than the radius of ring shaped tool 78, thus providing single point contact between ring shaped tool 78 and working surface 72. This simple relationship will not apply when the face of the tool is held at an angle to working surface 72 other than perpendicular.

Tool holder 80 is shown here as a straight line between points 76 and 82, passing through a subcenter 84, but could be any shape so long as ring shaped tool 78 is held in the same position.

Figure 8:
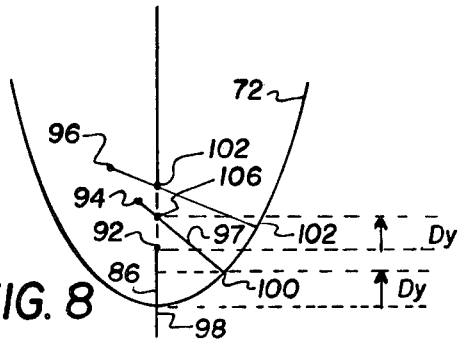
FIG. 8 is a diagram of the working surface showing various radii of curvature.

Effectively keeping a tool normal to the working surface presents practical difficulties. The method and apparatus of this invention employ the concept of subcenters, which are centers of rotation for tool holder 80 that do not necessarily correspond to the centers of curvature of the curve, in order to maintain a normal or near normal orientation of the tool. Various radii of curvature for a given curve vary in length and direction as shown by the three radii of curvature 86, 88 and 90 shown in FIG. 8 with their respective centers of curvature 92, 94 and 96 and intersecting curve 72 at points 98, 100 and 102 respectively. Lines 88 and 90 intersect the center line 104 at subcenters 106 and 108 respectively. Subcenter 92 for line 86 corresponds to its actual center of curvature 92 assuming that the apparatus of this invention is oriented as shown in the figures, a change in the vertical position on curve 72 is represented by Dy, then a change in the vertical position of the subcenter points will be $e^2Dy$ where e is the eccentricity of the curve. Eccentricity is defined as shown below:

| Parabola | Ellipse | Hyperbola |
|---|---|---|
| $x^2 = 4ay$ | $\frac{x^2}{a^2} + \frac{y^2}{b^2} = 1$ | $\frac{x^2}{a^2} - \frac{y^2}{b^2} = 1$ |
| $e = 1$ | $e = \frac{\sqrt{a^2 - b^2}}{a}$ | $e = \frac{\sqrt{a^2 + b^2}}{a}$ |

Figure 9:
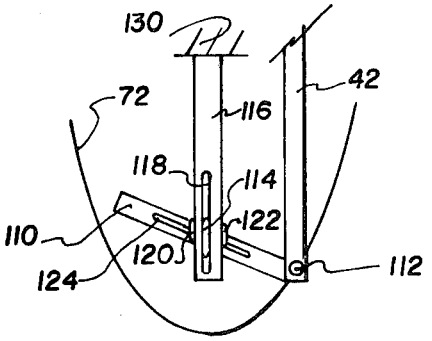
FIG. 9 is a diagram similar to FIG. 8 showing a mechanical means according to this invention for positioning a tool holder normal to the working surface.

Thus, for any given curve, the change in the vertical position of the subcenter points is a constant multiplied by the change in the vertical position of the corresponding points on the curve. Knowing how far one wishes to go up a curve on working on a particular working surface 72, one can calculate an average subcenter location which a tool can be pivoted about in order to create an approximate normal relationship to all of the points on the curve. Such an approximation works well for low tolerance applications such as for ophthalmic lenses. A simplified form of an approximating center of curvature guide in accordance with this invention is shown in FIG. 9 where vertical bar 42 moves one end of a virtual tool holder 110 along curve 72 by means of curve tracer 112 which can be more clearly seen in FIGS. 10 and 11, where virtual tool holder 110 is a bar used for positioning the actual tool holder 80 by moving in a manner similar to tool holder 80.

Figure 10:
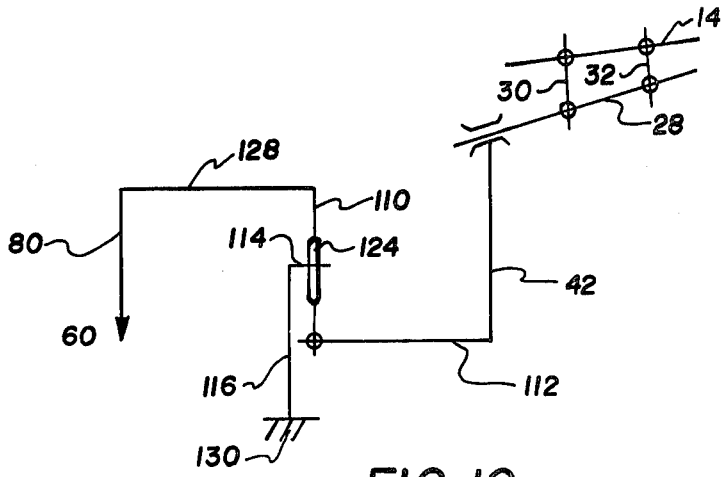
FIG. 10 is a simplified diagram of an apparatus for performing conic sectional operations on a workpiece utilizing an approximating center of curvature guide according to this invention.
Figure 11:
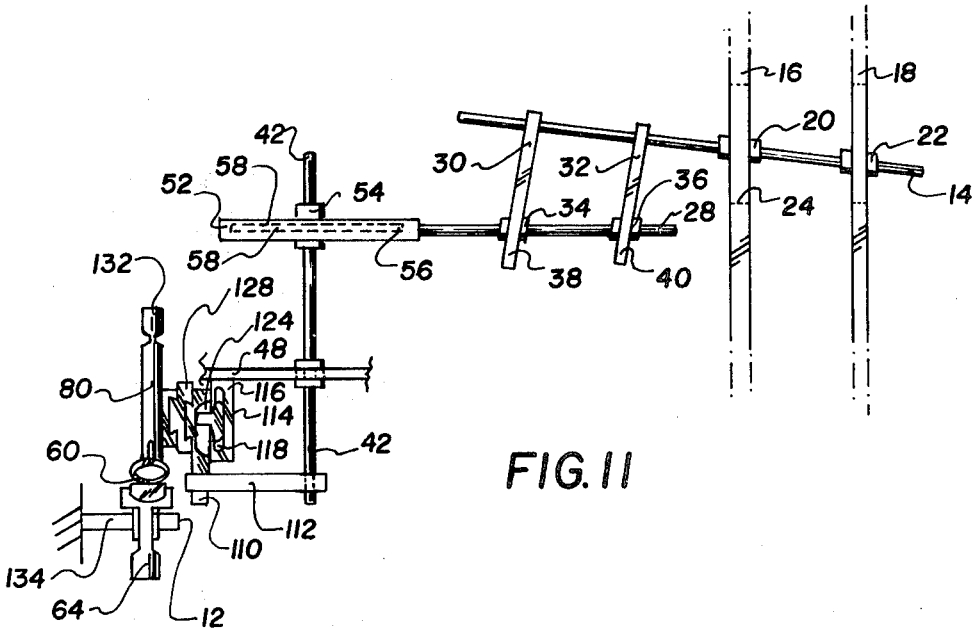
FIG. 11 is an elevational view of an apparatus similar to the diagram of FIG. 10.

The apparatus as shown in FIGS. 10 and 11 incorporates conic surface generator 11 and the cutting plane generator shown in FIGS. 1 through 4, but vertical bar 42 connects to the center of curvature guide rather than connecting directly to the working interface.

As shown in FIGS. 10 and 11, curve tracer 112 is free to rotate within virtual tool holder 110, but is fixed in relationship to vertical bar 42. This relationship could, of course, be reversed or curve tracer 112 can be made free to rotate with respect to both virtual tool holder 110 and vertical bar 42 so long as vertical bar 42 is not permitted to slide longitudinally with respect to curve tracer 112. Virtual tool holder 110 pivots about subcenter pin 114 which is mounted in pin support 116 which forms a slot 118 for accepting the subcenter pin. In the embodiment shown in FIG. 9, the subcenter pin 114 can be fixed in a given position in slot 118 by bolt 120 and nut 122. Virtual tool holder 110 forms a slot 124 for receiving a portion of subcenter pin 114 so that virtual tool holder 110 can rotate about pin 114 or slide longitudinally. Thus, referring to FIG. 9, the end of virtual tool holder 110 connected to curve tracer 112 traces a curve corresponding to working surface 72 while virtual tool holder 110 stays approximately normal to the curve as the curve is traced.

Tool holder 80 in FIG. 10 is maintained in a fixed relationship to vertical holder 110 by a tool pointer 128 as shown in FIGS. 10 and 11 where tool pointer 128 is a means of connecting tool holder 80 to virtual tool holder 110 whereby the two will move in a similar manner. Since tool holder 80 is maintained in a fixed position relative to virtual tool holder 110, working interface 60 follows working surface 72 as the curve tracer end of virtual tool holder 110 moves in the corresponding pattern. Tool pointer 128 as shown in FIG. 11 can be rotatably adjusted with respect to virtual tool holder 110 and tool holder 80. This allows the tool holder to be fixed in a position at an angle to virtual tool holder 110 in order to allow for the shape of working interface 60 which might be a cup-shaped tool as shown in FIG. 11. Once tool holder 80 is rotatably adjusted with respect to virtual tool holder 110, it is then locked into its relative position. Pin support 116 can be affixed to any support 130 which does not move with respect to the apparatus such as plane guide 48 shown in FIG. 11. Work piece motors 64 can also be used in this configuration as can a tool motor 132 for revolving the working interface. A means 134 for supporting the workpiece can include a means for pivoting the workpiece back and forth while the workpiece is being operated on for creating different shapes of working surfaces.

As apparatus employing an alternative embodiment of the center of curvature guide of this invention is illustrated in FIGS. 12, 13 and 14 where elements corresponding to elements shown in other embodiments are numbered the same as in the previous figures.

As shown in FIG. 12, virtual tool holder 110 pivots about pin 114 in the same manner described for the previous embodiment of the center of curvature guide, but pin 114 rather than being in a fixed position for a given curve as shown in FIGS. 10 and 11, moves up and down so that it always corresponds to the actual subcenter point at any given time, thus providing greater accuracy. As already described, the change in position of subcenters for two different points along a curve is a constant times the change in vertical position between the two points.

The center of curvature guide of this embodiment uses a two step approach to properly position subcenter pin 114. The first step is to detect the change in vertical position between the two points on the curve through a means for transmitting a change in vertical position, and the second stage is to multiply the change in vertical position by means of a constant multiplier. One means for transmitting a change in vertical position is a slider 136 affixed to vertical bar 42 but free to slide transversely with respect to vertically moving element 138. One form of a constant multiplier is a lever 140 and fulcrum 142, but since a lever and fulcrum multiplies by a minus constant, a minus one multiplier 144 is placed in series with the lever and fulcrum so that a positive constant multiplier is achieved. Minus one multiplier 144 is an endless belt 146 wrapped around pulleys 148 so that any change in vertical position of vertical bar 42 transmitted through slider 136 and vertically moving element 138 will be transmitted an equal distance but opposite direction from minus one multiplier 144 to lever 140.

Lever 140, as shown, is of a constant length and, therefore, needs to be adjustable within fulcrum 142 so that the ratio of the lever arms can be changed for different curves. The ratio of the lever arms will be set for the constant of the particular curve being generated.

The result of this system is the constantly varying of the position of subcenter pin 114 or its equivalent subcenter bar 147 in FIG. 14 so that it always corresponds to the actual subcenter. Pin positioner 150 transmits change in vertical position from lever 140 to subcenter pin 114 or subcenter bar 147.

As shown in FIGS. 13 and 14, virtual tool holder 110 and curve tracer 112 have been replaced by rigid transmitting member 152 which transmits the desired tool orientation to tool pointer 128. Trnasmitting member 152 forms a slot 154 for receiving a means for positioning a subcenter such as subcenter pin 114 or subcenter bar 147 whereby transmitting member 152 is pivoted about the positioning means by vertical bar 42.

To function properly, lever 140 must be pivotally connected to minus one multiplier 144 and to pin positioner 150. Fulcrum 142 must be such that it can be locked into position, thus fixing the ratio of the arm lengths of lever 140 for any given curve. In the embodiment shown in FIG. 14, fulcrum 142 is connected to fulcrum slider 156 which slides along fulcrum rail 158. Fulcrum 142 can slide horizontally without affecting the constant multiplication so long as lever 140 does not slide longitudinally with respect to the fulcrum.

As with the conic generator, the cutting plane generator and the conic section follower, the positioning functions of the center of curvature guide can be performed by computer. For example, the multiplying constant for a given curve can be calculated and the change in the vertical position along a curve calculated and the two multiplied, thus computing the change in the position of the subcenter.

The use of the center of curvature guide provides a built-in means for varying certain curve parameters by simply changing the position of tool holder 80 so that the effective length between tool pointer 128 and working interface 60 is changed.

Another variation of the kind of curve which can be generated can be effected by moving axial shaft 14 in an oscillatory manner periodic to the motion of slant shaft 28 rather than maintaining axial shaft 14 stationary.

The use of the term "working surface" in the description of the preferred embodiments includes substantially two dimensional workpieces such as cams.

For mass producing workpieces, many tool holders can be held substantially in parallel by numerous tool pointers so that the tools are moved in unison across their respective workpieces.

From the foregoing it will be seen that this invention is well adapted to obtain all of the ends and objects hereinabove set forth, together with the other objects which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. An apparatus for performing conic sectional operations on a workpiece comprising, in combination;
- a conic surface generator for describing a cone;
- a cutting plane generator for describing a plane;
- a conic section follower connected to the conic surface generator and connected to the cutting plane generator whereby the follower follows the intersection of the cutting plane and the cone as the cone is generated;
- a working interface for working on a workpiece; and
- means for connecting the working interface to the conic section follower whereby the working interface traces the conic section generated by the intersection of the cone and the plane.

2. The apparatus of claim 1, wherein the conic surface generator comprises:
- an axial shaft; and
- a slanted shaft rotatably connected to the axial shaft and at an angle thereto whereby rotating the slant shaft about the axial shaft describes a conic surface.

3. The apparatus of claim 2, wherein the cutting plane generator comprises:
- a bar;
- a plane guide forming a linear slot; and
- a means for retaining the bar within the slot at a fixed angle to the slot while allowing the bar to slide longitudinally along the axis of the slot and longitudinally along the axis of the bar.

4. The apparatus of claim 3, wherein the means for connecting the working interface to the conic section follower comprises the bar of the cutting plane generator.

5. The apparatus of claim 1, wherein the cutting plane generator comprises:
- a bar;
- a plane guide forming a linear slot; and
- a means for retaining the bar within the slot at a fixed angle to the slot while allowing the bar to slide longitudinally along the axis of the slot and longitudinally along the axis of the bar.

6. The apparatus of claim 5, wherein the means for connecting the working interface to the conic section follower comprises the bar of the cutting plane generator.

7. The apparatus of claim 1, wherein the means for connecting the working interface to the conic section follower comprises a bar.

8. The apparatus of claim 7, wherein the conic surface generator comprises:
- an axial shaft;
- a slanted shaft rotatably connected to the axial shaft and at an angle thereto whereby rotating the slant shaft about the axial shaft describes a conic surface.

9. The apparatus of claim 1, wherein the means for connecting the working interface to the conic section follower comprises:
- a means for adjusting the angle of the working interface with respect to the workpiece during the performance of conic sectional operations so that the locus of the point of contact between the working interface and the workpiece traces the conic section generated by the intersection of the cone and the plane.

10. The apparatus of claim 9, wherein the conic surface generator comprises:
- an axial shaft; and
- a slanted shaft rotatably connected to the axial shaft and at an angle thereto whereby rotating the slant shaft about the axial shaft describes a conic surface.

11. The apparatus of claim 10, wherein the cutting plane generator comprises:
- a bar;
- a plane guide forming a linear slot; and
- a means for retaining the bar within the slot at a fixed angle to the slot while allowing the bar to slide longitudinally along the axis of the slot and longitudinally along the axis of the bar.

12. The apparatus of claim 11, wherein the means for connecting the working interface to the conic section follower comprises the bar of the cutting plane generator.

* * * * *